US007600549B2

(12) United States Patent
Cheng

(10) Patent No.: US 7,600,549 B2
(45) Date of Patent: Oct. 13, 2009

(54) WINDOW COVERING CUTTING AND BONDING APPARATUS

(76) Inventor: Li-Ming Cheng, No.215, Jiouru 1 st Rd., Sanmin Dist., Kaohsiung City (TW)

( * ) Notice: Subject to any disclaimer, the term of this patent is extended or adjusted under 35 U.S.C. 154(b) by 277 days.

(21) Appl. No.: 11/525,175

(22) Filed: Sep. 22, 2006

(65) Prior Publication Data

US 2008/0073037 A1 Mar. 27, 2008

(51) Int. Cl.
*E06B 3/48* (2006.01)

(52) U.S. Cl. ..... 160/84.05; 428/41.8

(58) Field of Classification Search ..... 160/84.04, 160/84.05, 178.1 R; 428/41.8
See application file for complete search history.

(56) References Cited

U.S. PATENT DOCUMENTS 3,913,655 A * 10/1975 Ogino ..... 160/84.01
5,158,127 A * 10/1992 Schumacher ..... 160/84.07
6,773,779 B2 * 8/2004 Franck et al. ..... 428/40.1
2006/0180277 A1 * 8/2006 Lin ..... 160/84.04
2008/0073037 A1 * 3/2008 Cheng ..... 160/84.05

* cited by examiner

*Primary Examiner*—Blair M. Johnson
(74) *Attorney, Agent, or Firm*—Muncy, Geissler, Olds & Lowe, PLLC

(57) ABSTRACT

A window covering cutting and bonding apparatus includes a release sheet on an adhesive tape on an upper end and a bottom end of a window covering assembly. The release sheet is extended inwards from one side of a top end and a bottom end and bent and extended outwards to extend to outside the ends of an upper rail and a lower rail and form a preset pulling strip. Before a window covering is cut and trimmed, the release sheet can be moved in a skewed manner through the preset pulling strip. After the window covering assembly is cut and trimmed, the preset pulling strip can be pulled outwards to peel off the release sheet quickly at the same time. Therefore the adhesive tape can be exposed to bond to the upper rail and the lower rail of the window covering.

2 Claims, 8 Drawing Sheets

WINDOW COVERING CUTTING AND BONDING APPARATUS

FIELD OF THE INVENTION

The present invention relates to a window covering cutting and bonding apparatus and particularly to a bonding apparatus which has a release sheet located between a window covering assembly, an upper rail, and a lower rail and attached to an adhesive tape that can be peeled off rapidly to facilitate bonding of the window covering assembly to the upper rail and the lower rail.

BACKGROUND OF THE INVENTION

A great number of window coverings now on the market are installed by users after purchase. As the specifications of the purchased window coverings often do not exactly match the width of doors or windows in the houses, users have to trim the width of the window covering assembly during installation to match the width of the doors or windows.

FIGS. 1 and 2 illustrate a conventional window covering 10 which has an upper rail 11 and a lower rail 12 and a retractable and extendable window covering assembly 13 located between the lower rail 12 and the upper rail 11. The window covering assembly 13 has an adhesive tape 130 on the bottom end with a release sheet 14 attached thereon. While the window covering assembly 13 may be cut and trimmed to match the width of a door or window, it also creates problems as follow:

1. The window covering assembly 13 usually has a portion on one side not bonding with the upper rail 11 and the lower rail 12. After the window covering assembly 13 is cut, the one side of the window covering assembly 13, the upper rail 11 and the lower rail 12 form a smaller included angle. Peeling off the release sheet 14 from the attached adhesive tape 130 on the bottom end of the window covering assembly 13 is difficult (referring to FIG. 2). As a result, bonding of the window covering assembly 13, the upper rail 11, and the lower rail 12 is not always in a desired condition.

2. The release sheet 14 attached to the adhesive tape 130 is formed at a length same as the unglued portion of the window covering assembly 13. After the window covering assembly 13 has been trimmed, peeling off the release sheet 14 can be done only in the smaller included angle between the window covering assembly 13, the upper rail 11, and the lower rail 12. Peeling operation of the release sheet 14 is difficult and takes more time. There are still rooms for improvement.

SUMMARY OF THE INVENTION

Therefore the primary object of the present invention is to provide a window covering cutting and bonding apparatus adopted for use on a window covering that has a window covering assembly, an upper rail and a lower rail. The invention has a preset pulling strip on one side of a bottom end of the window covering assembly to facilitate fast peeling of a release sheet attached to an adhesive tape on the top end and the bottom end of the window covering assembly and achieve a secure bonding between the window covering assembly, the upper rail, and the lower rail.

To achieve the foregoing object, the window covering cutting and bonding apparatus of the invention includes a bonding means on the window covering assembly that has an adhesive tape on the top end and the bottom end of the window covering assembly and a release sheet attached to the adhesive tape. The release sheet is extended inwards from one side of the bottom end of the window covering assembly and bent outwards to extend to outside the ends of the upper rail and the lower rail and form the preset pulling strip.

According to the structure design of the release sheet, the present invention can reach the following effect. Before a window covering is cut and trimmed, the release sheet can be moved in a skewed manner through the preset pulling strip. After the window covering assembly is cut and trimmed, the preset pulling strip can be pulled outwards to peel off the release sheet quickly at the same time. Therefore the adhesive tape can be exposed to bond to the upper rail and the lower rail of the window covering.

The window covering cutting and bonding apparatus thus formed can achieve the following effects:

1. After the window covering assembly is cut and trimmed, the pulling strip on one end of the release sheet may be peeled off to remove the release sheet quickly from the adhesive tape, then the adhesive tape on the upper end and the bottom end of the window covering assembly can be bonded to the upper rail and the lower rail.

2. More convenient cutting and bonding operations: After the retracted window covering has been cut and trimmed, the release sheet on the top end and the bottom end of the window covering assembly can be peeled off rapidly through the preset pulling strip. The follow on bonding operation can be done easier and faster.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
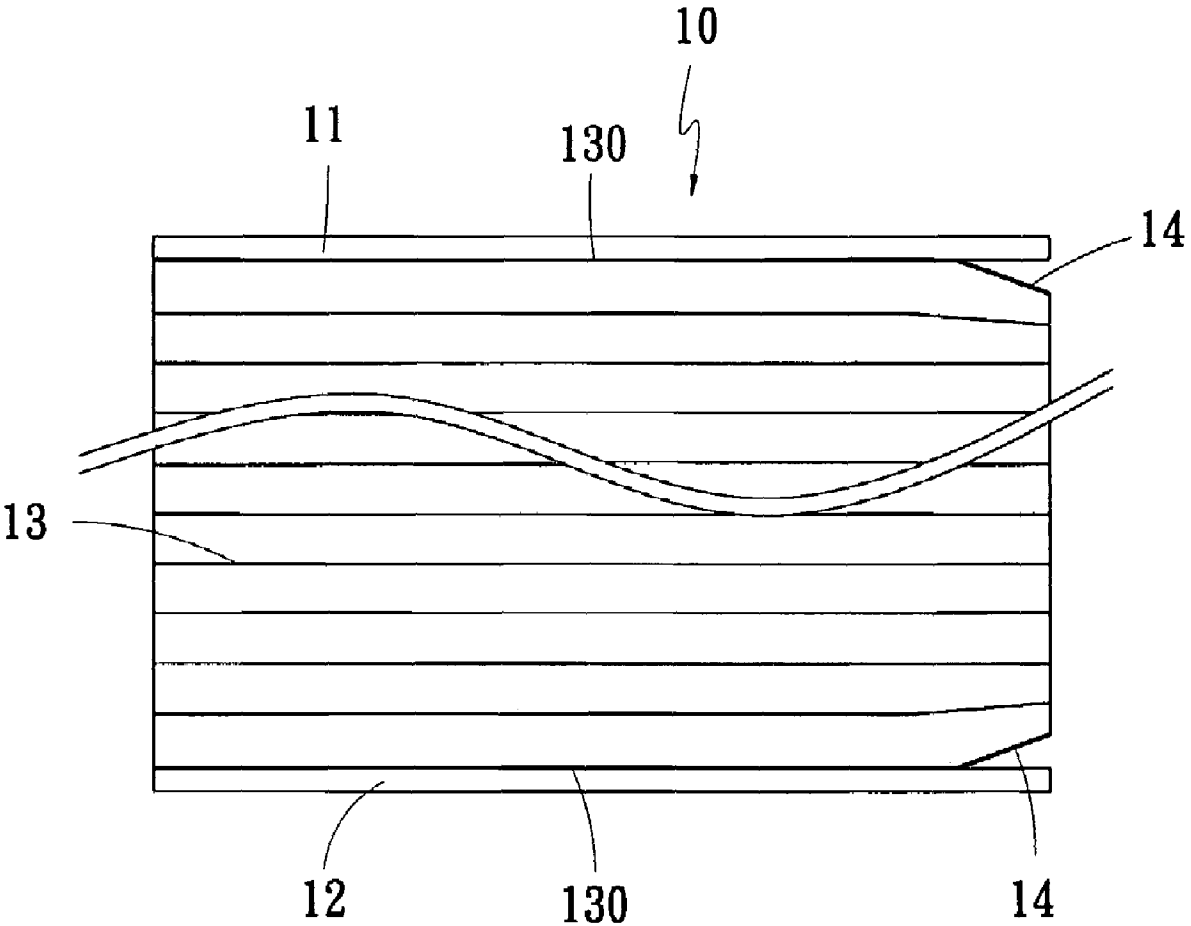
Fig. 1 PRIOR ART
FIG. 1 is a front view of a conventional window covering with a release sheet.
Figure 2:
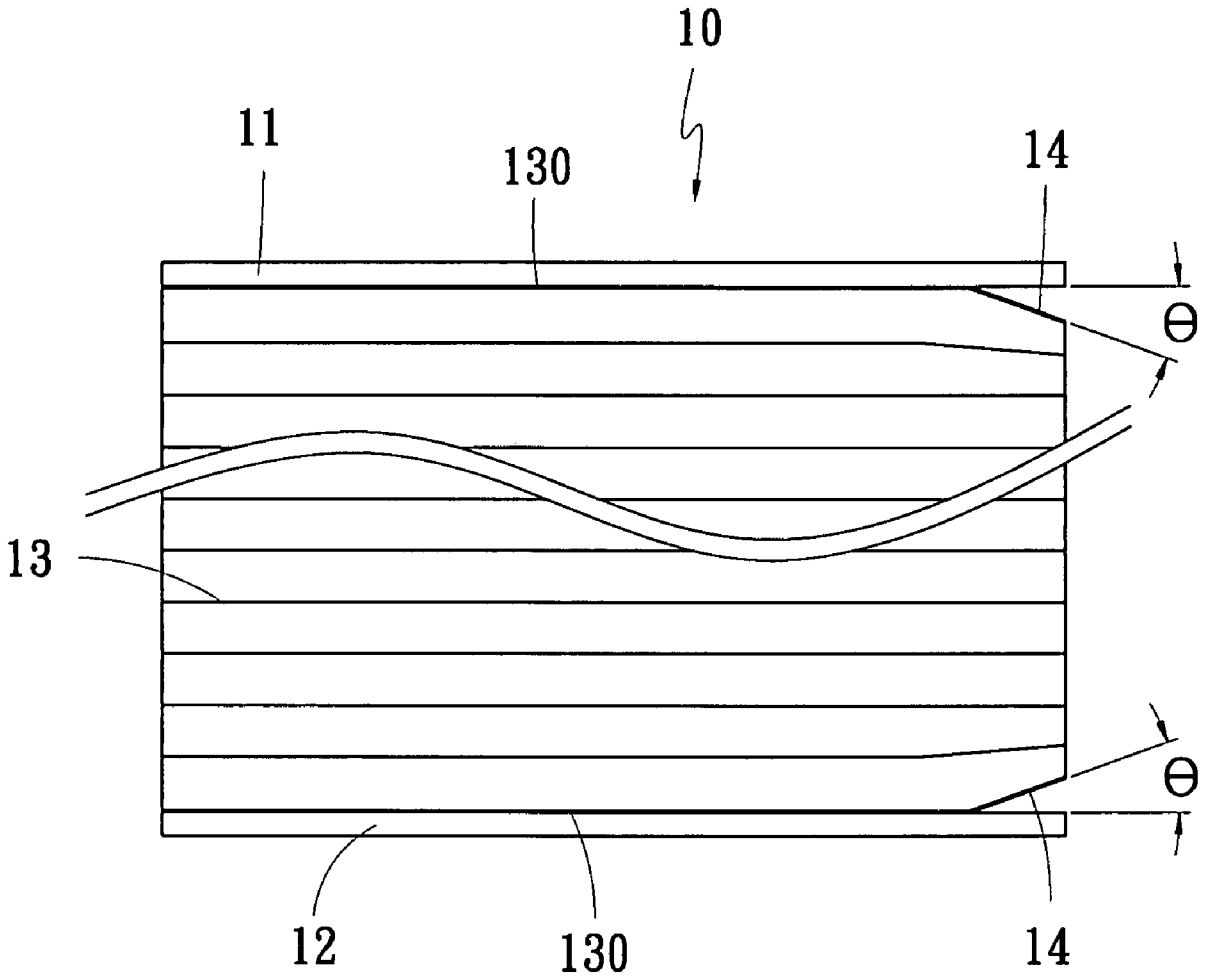
Fig. 2 PRIOR ART
FIG. 2 is a fragmentary enlarged view of peeling the release sheet according to FIG. 1.
Figure 3A:
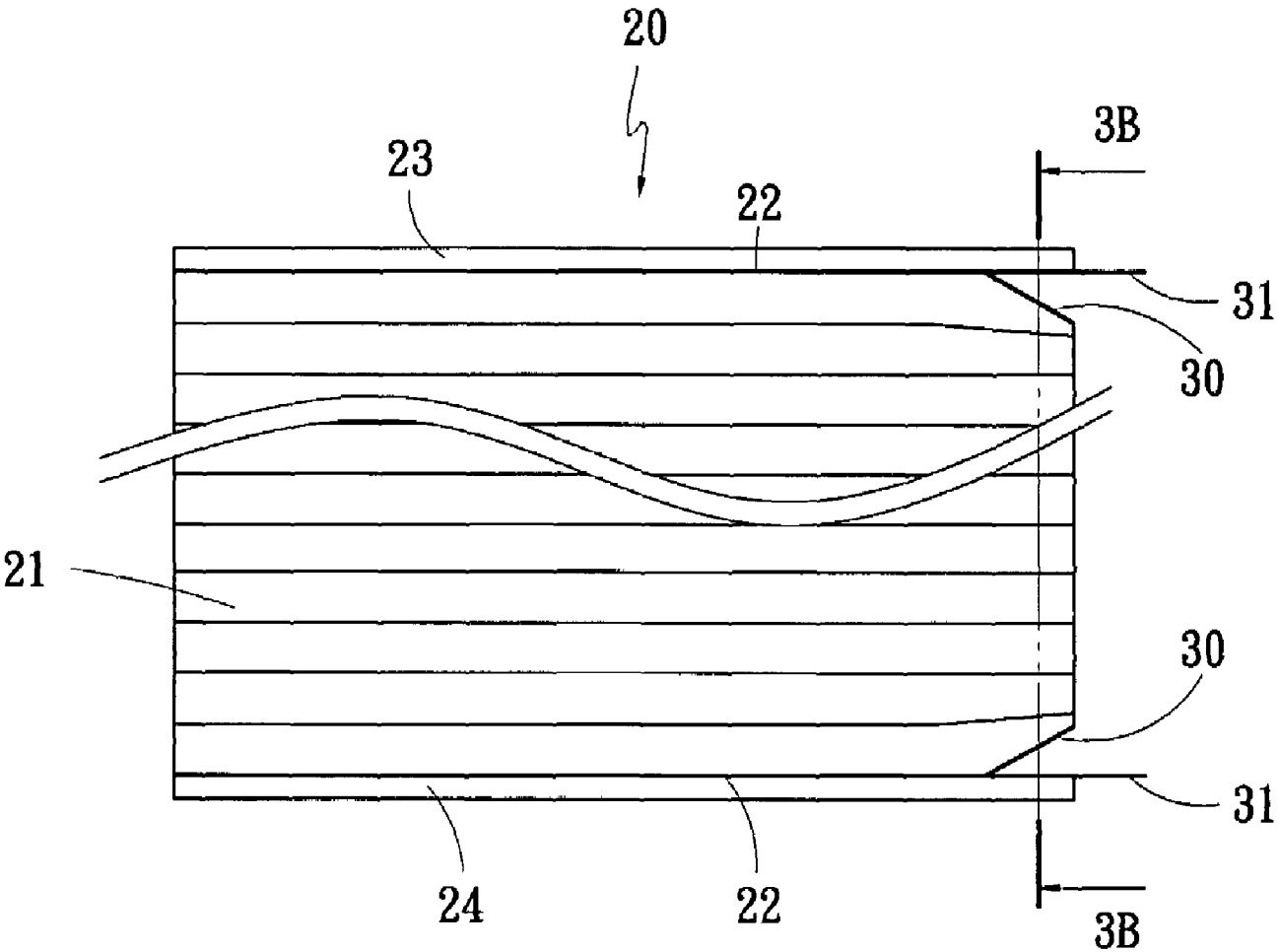
FIG. 3A is a front view of the invention showing the location of the release sheet on a bonding means.
Figure 3B:
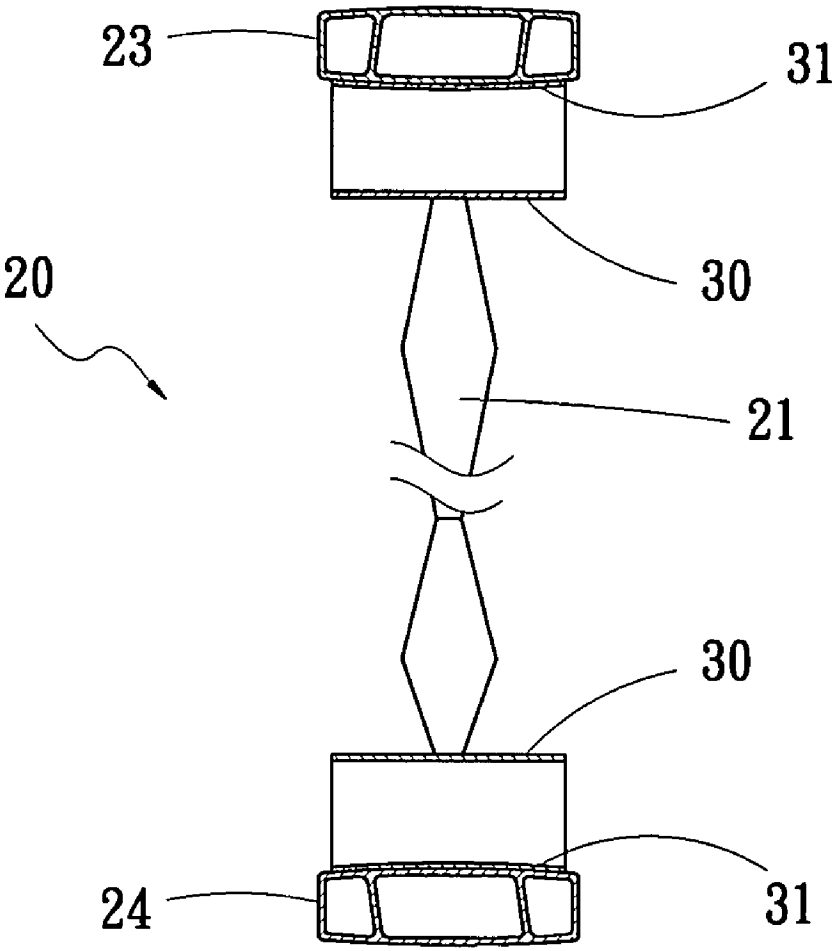
FIG. 3B is a cross-sectional view of 3B-3B in FIG. 3A.

Please refer to FIG. 3A, the window covering 20 according to the invention has a window covering assembly 21 with a bonding means located thereon that includes an adhesive tape 22 on a top end and a bottom end of the window covering assembly 21 and a release sheet 30 attached to the adhesive tape 22. As shown in FIGS. 3A and 3B, the release sheet 30 is extended inwards from one side of the bottom end of the window covering assembly 21 and is bent and extended outwards to extend to outside the ends of an upper rail 23 and a lower rail 24 and form the preset pulling strip.

The preset pulling strip 31 thus designed is formed on one end of the release sheet 30 and extended outwards from one side of the window covering assembly 21 as shown in an embodiment shown in the drawings.

Figure 4:
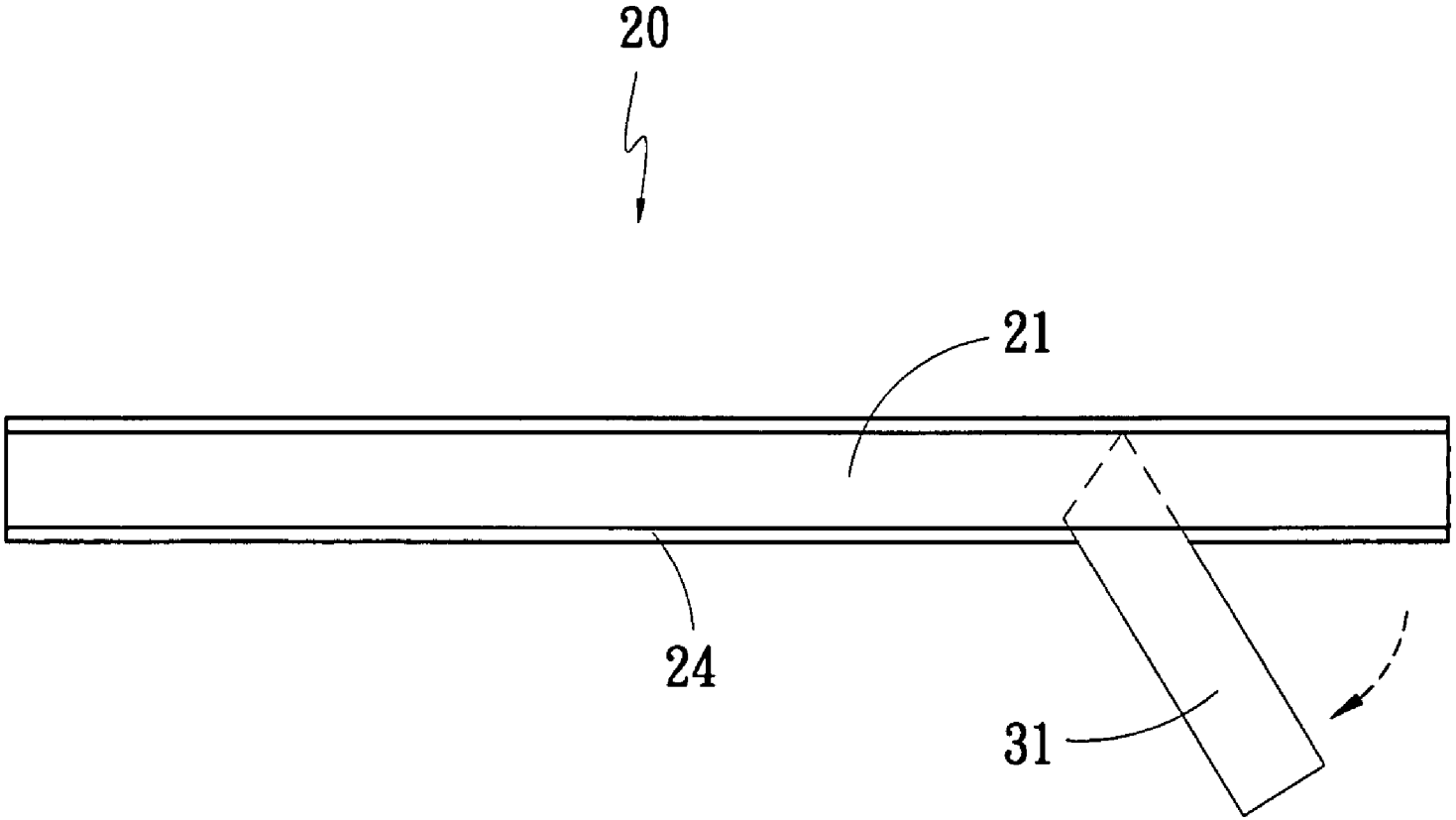
FIG. 4 is a top view of the invention showing the preset pulling strip in a move-away condition on the lower rail.

Referring to FIG. 4, the preset pulling strip 31 can be moved in any direction under the upper rail 23 and above the lower rail 24.

Figure 5:
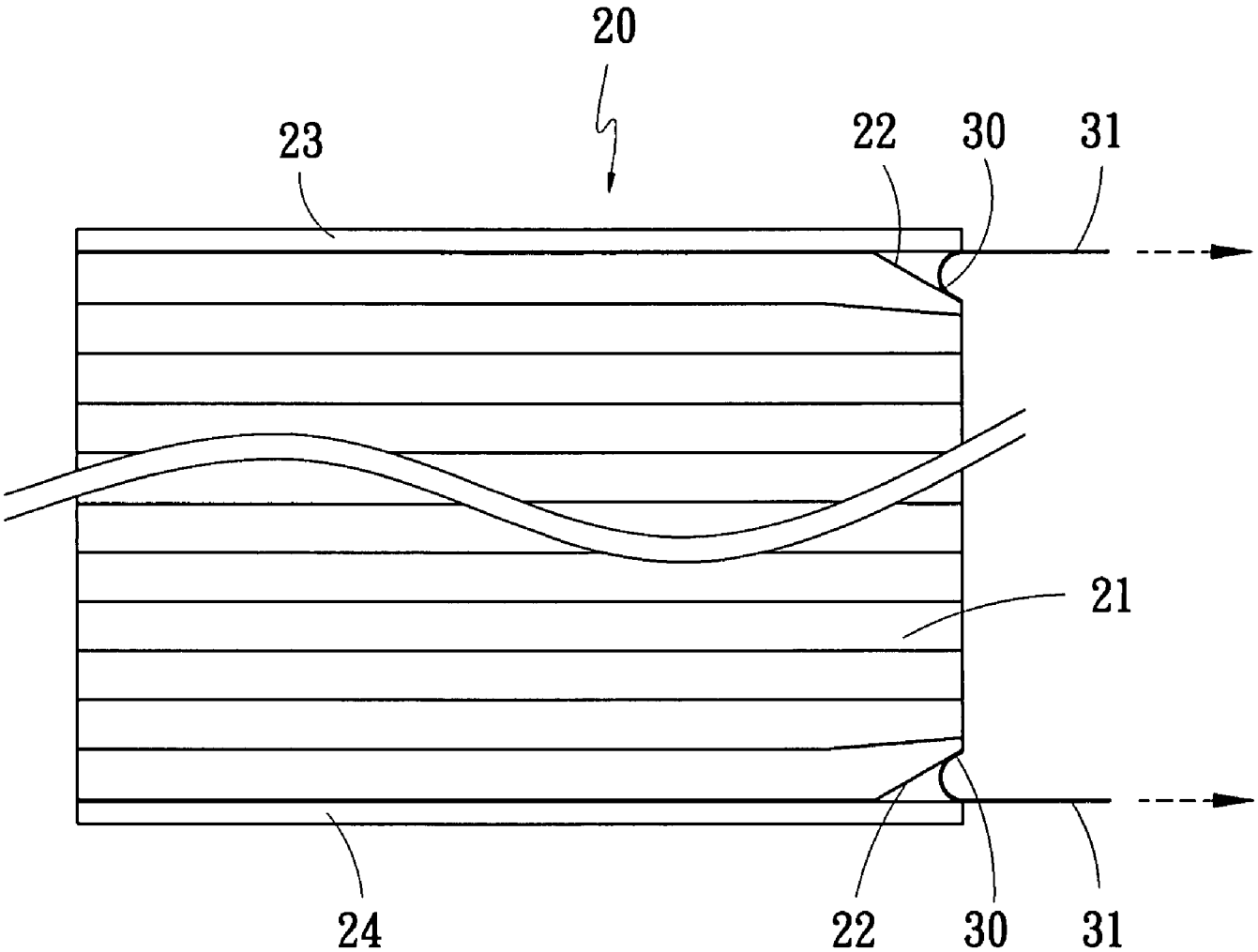
FIG. 5 is a schematic view of the invention showing the release sheet in a peeling condition.
Figure 6:
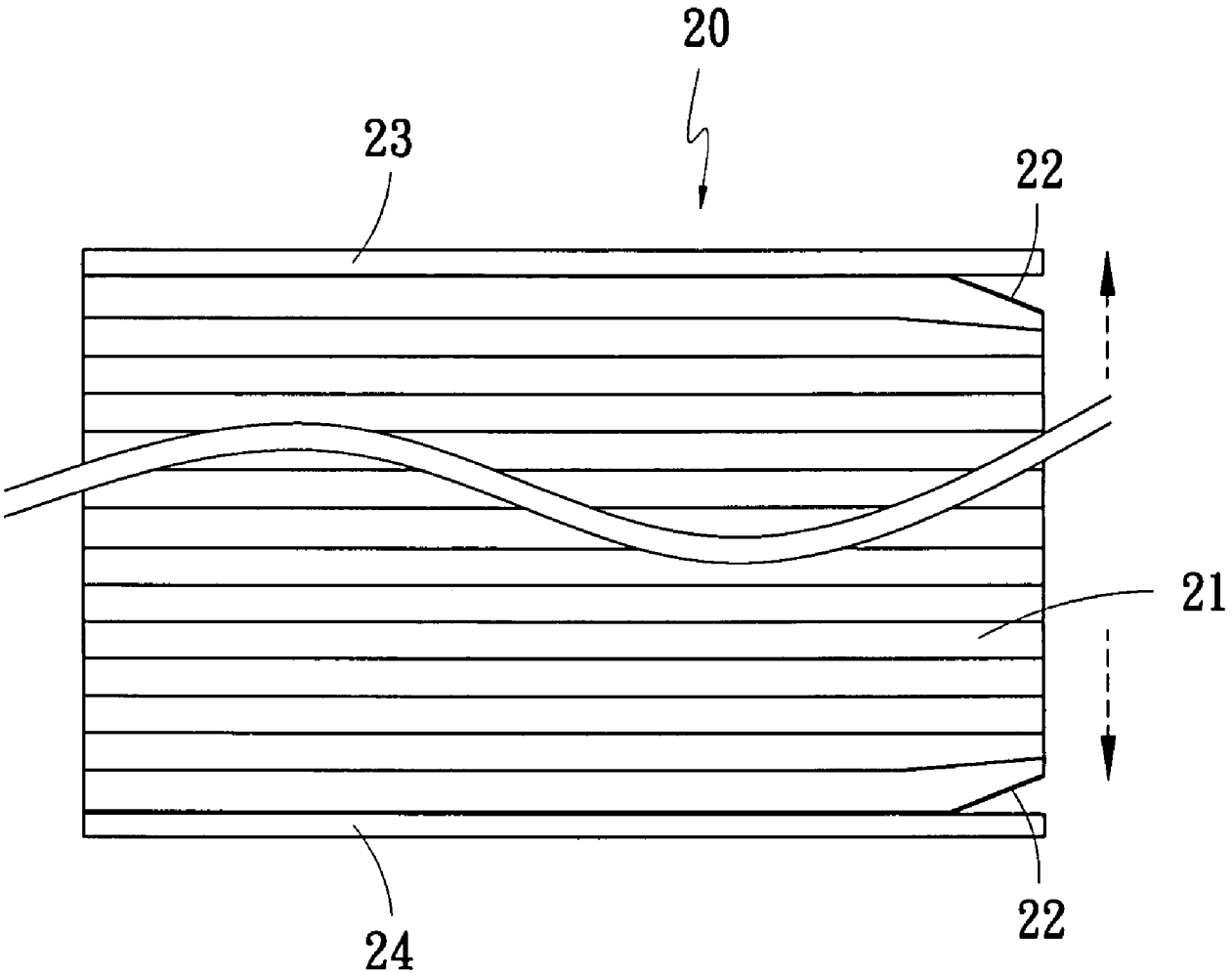
FIG. 6 is a schematic view of the invention showing the adhesive tape located on the top end and bottom end of the window covering assembly.
Figure 7:
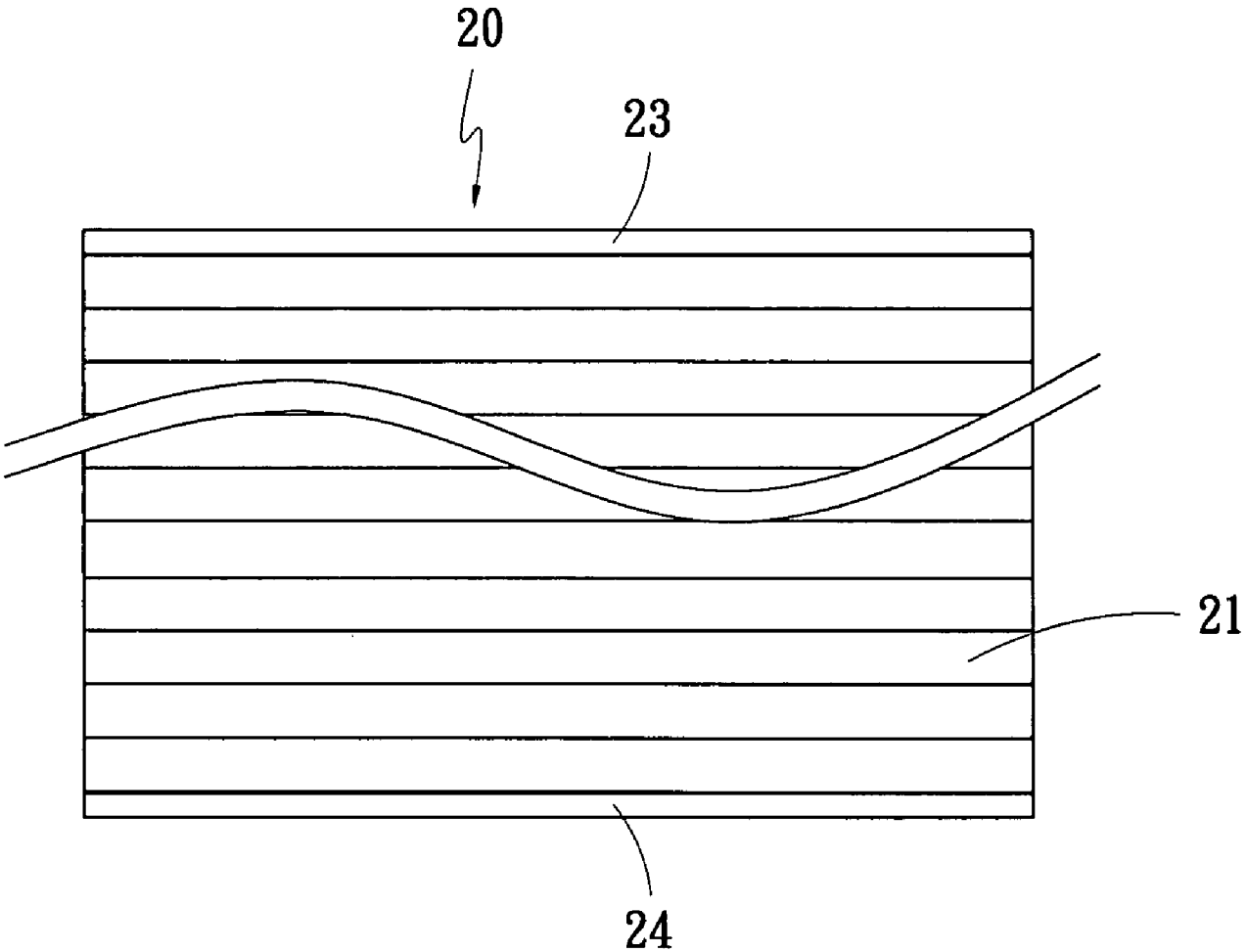
FIG. 7 is a front view of the invention showing the window covering assembly, the upper rail, and the lower rail in a bonding condition.

Referring to FIG. 4, when in use, before the window covering 20 is cut and trimmed, the present pulling strip 31 is moved in a skewed manner against the upper rail 23 and lower rail 24 to facilitate cutting operation of the window covering 20. Then the preset pulling strip 31 can be gradually pulled out to peel off the release sheet 30 attached to the adhesive tape 22 (referring to FIG. 5). Thus the adhesive tapes 22 on the top end and the bottom end of the window covering assembly 21 are exposed and can be bonded rapidly to the upper rail 23 and the lower rail 24 (referring to FIGS. 6 and 7). There is no need to peel off the release sheets 30 on the top end and the bottom end of the window covering assembly 21, and no waste of time occurs.

In short, the window covering cutting and bonding apparatus of the invention provides the following features:

1. After the window covering assembly 21 of the window covering 20 has been cut and trimmed, due to the bonding means on the top end and the bottom end of the window covering assembly 21 has a release sheet 30 attached to the adhesive tape 22 and a preset pulling strip 31 on another end of the release sheet 30, the preset pulling strip 31 may be peeled off to remove the release sheet 30 at the same time so that the adhesive tapes 22 on the top end and the bottom end of the window covering assembly 21 may be exposed to be bonded instantly to the upper rail 23 and the lower rail 24.

2. After the retracted window covering assembly 21 has been cut and trimmed, the release sheets 30 on the top end and the bottom end of the window covering assembly 21 can be peeled off rapidly through the preset pulling strip 31 to facilitate the follow-on bonding operation.

As a result, the window covering cutting and bonding apparatus of the invention not only allows the release sheet 30 interposed between the window covering assembly 21, the upper rail 23, and the lower rail 24 to be peeled off rapidly, it also can accomplish bonding quickly between the window covering assembly 21, the upper rail 23, and the lower rail 24 in a smaller space.

What is claimed is:

1. A window covering cutting and bonding apparatus for a window covering having an upper rail, a lower rail and a window covering assembly, said window covering assembly having a top and a bottom with ends of the top and bottom being at an acute angle to the top and bottom rails respectively, said cutting and bonding apparatus comprising:

an adhesive tape on each of the top end and the bottom end of the window covering assembly and a release sheet on each adhesive tape, the release sheets extending inwardly from one side of each of the top end and the bottom end, said release sheets being bent at an acute angle and extending outwardly along corresponding top and bottom rails to extend beyond ends of the upper rail and the lower rail to form a preset pulling strip.

2. The window covering cutting and bonding apparatus of claim 1, wherein the preset pulling strip is located under the upper rail and above the lower rail of the window covering.

* * * * *